US008033969B2

(12) United States Patent
Feltz

(10) Patent No.: US 8,033,969 B2
(45) Date of Patent: Oct. 11, 2011

(54) PILATES EXERCISE BARREL

(76) Inventor: Diana Feltz, Fort Worth, TX (US)

( * ) Notice: Subject to any disclaimer, the term of this patent is extended or adjusted under 35 U.S.C. 154(b) by 0 days.

(21) Appl. No.: 12/486,893

(22) Filed: Jun. 18, 2009

(65) Prior Publication Data

US 2010/0152004 A1 Jun. 17, 2010

Related U.S. Application Data

(60) Provisional application No. 61/073,400, filed on Jun. 18, 2008.

(51) Int. Cl.
*A63B 26/00* (2006.01)

(52) U.S. Cl. ..... 482/142

(58) Field of Classification Search ..... 482/142, 482/140, 91, 907, 23; 446/120–128
See application file for complete search history.

(56) References Cited

U.S. PATENT DOCUMENTS

| | | | | |
|---|---|---|---|---|
| 1,874,613 | A | 8/1932 | Pilates | |
| 1,969,901 | A | 8/1934 | Pilates | |
| 2,132,862 | A | 10/1938 | Pilates | |
| 2,675,286 | A | 4/1954 | Derman | |
| 3,759,512 | A | 9/1973 | Yount et al. | |
| 4,114,542 | A | 9/1978 | Fentress | |
| 4,869,494 | A | 9/1989 | Lambert, Sr. | |
| 4,913,423 | A | 4/1990 | Farran et al. | |
| 5,044,633 | A | 9/1991 | Rice | |
| 5,176,601 | A | 1/1993 | Reynolds | |
| 5,273,503 | A | 12/1993 | Hershey | |
| 5,308,302 | A | 5/1994 | Miller | |
| 5,527,243 | A | 6/1996 | Chen | |
| 5,569,138 | A | 10/1996 | Wang et al. | |
| 5,674,167 | A | 10/1997 | Piaget et al. | |
| 5,690,379 | A * | 11/1997 | Cayssials | 297/118 |
| 5,704,691 | A | 1/1998 | Olson | |
| 6,142,914 | A | 11/2000 | Crawford et al. | |
| 6,334,624 | B1 | 1/2002 | Giglio | |
| 6,482,134 | B1 | 11/2002 | Rasmussen | |
| 6,494,819 | B1 | 12/2002 | Boland | |
| 6,524,355 | B1 * | 2/2003 | Jenkins | 48/52 |
| 6,578,218 | B2 * | 6/2003 | Wassilefsky | 5/648 |

(Continued)

OTHER PUBLICATIONS

Balanced Body Pilates-Ladder Barrel, Ped-A-Pul, Tower, Sep. 17, 2005, Balanced Body, Inc., http://www.pilates.com/ladderpedalpul.html, 2 pages.

(Continued)

*Primary Examiner* — Lori Baker
(74) *Attorney, Agent, or Firm* — Decker Jones, et al.; Brian K. Yost; Geoffrey A. Mantooth

(57) ABSTRACT

An exercise apparatus comprised of a base, a plurality of walls, and a user area, said user area being comprised of a sitting portion and a bending portion, wherein said bending portion is above the sitting portion when a user is seated on said sitting portion, wherein said base is formed by said walls; and wherein said walls, sitting portion, and bending portion to an opening.

An exercise apparatus comprised of a base and a rocking portion, said base being comprised of a plurality of walls, and a user area, said user area being comprised of a sitting portion and a bending portion, wherein said bending portion is above the sitting portion when a user is seated on said sitting portion, wherein said base is formed by said walls; and wherein said walls, sitting portion, and bending portion form an opening.

13 Claims, 4 Drawing Sheets

U.S. PATENT DOCUMENTS

| | | | | |
|---|---|---|---|---|
| 6,648,358 | B2 | 11/2003 | Catanescu et al. | |
| 6,676,581 | B1 | 1/2004 | Lin | |
| 6,824,208 | B2 | 11/2004 | Zheng | |
| 7,108,330 | B2 | 9/2006 | Mizelle et al. | |
| 7,452,313 | B2 * | 11/2008 | Endelman | 482/140 |
| 7,563,217 | B2 * | 7/2009 | Endelman | 482/142 |
| 2003/0057757 | A1 | 3/2003 | Martin | |
| 2003/0119635 | A1 | 6/2003 | Arbuckle | |
| 2005/0215400 | A1 | 9/2005 | Nerenberg | |

OTHER PUBLICATIONS

Ron Fletcher Works, Ped-A-Pul, Spine Corrector, 1 page brochure.
Pilates, Chairs, Ped-A-Pul and C-Shaper, 1 page brochure.
Pilates, Finely Crafted Pilates Equipment, Ladder Barrels, Step Barrels, Baby Arcs, Ped-A-Pul, Balanced Body, Sacramento, CA, Feb. 2005, 3 pages of brochure.
Pilates Physicalmind Institute, Pilates Chair brochure, 2004, 6 pages.
Stott Pilates, One Source Multiple Solutions brochure, Merrithew Corporation, Toronto, Ontario, Canada, 2005, 6 pages.

* cited by examiner

PILATES EXERCISE BARREL

This application claims the benefit of provisional application Ser. No. 61/073,400, filed Jun. 18, 2008, the contents of which are incorporated by reference herein its entirety.

BACKGROUND OF THE INVENTION

1. Field of the Invention

This disclosure relates to exercise equipment and more particularly exercise equipment for use in Pilates related movements and exercises.

2. General Background

Physical exercise is beneficial to human health in many ways. Improved circulation, increased immunity, greater physical strength, endurance, as well as sharpened mental alertness are just a few of the many health benefits of exercise. Resistance and flexibility training exercises help develop muscle tone while providing other valuable health benefits.

In the early part of the last century, an effective, low impact form of exercise was developed. This "new" exercise system introduced by Joseph Pilates drew upon yoga and ancient exercise techniques. The system, known today by many as the "Pilates" method, incorporates spring tensions and an emphasis on precise, smooth, flowing movements, and total body conditioning achieved through proper body alignment, concentration, and breathing. Although Mr. Pilates originally developed the system to rehabilitate bedridden soldiers, the method is used by many persons today, including expectant mothers, as a primary exercise technique as well as to rehabilitate.

3. Description of the Prior Art

Numerous devices have been developed to allow users to perform individual flexibility and resistance training. Some devices have been developed that allow the user to perform resistance exercises while standing on a flat base. Other devices allow training from a horizontal or prone position. Still other devices allow flexibility training from a seated position by use of a convex barrel device. While convex barrels offer the user an increased number of exercises and help develop increased flexibility, the devices currently available fail to provide the necessary stability for performing these exercises for many populations and fail to maintain the user in the proper exercise position. What is advantageous and necessary is a safe, lightweight, Pilates Barrel Exercise device that will remain stable during a variety of exercises and will help maintain the user's body in the proper position.

The exercise equipment of the present invention is a two-part mainframe comprised of parts that may rest on top of the other on a suitable surface or joined to each other by a coupling device, or nested when stored.

In one embodiment, the first of the two parts, the main body, is comprised of a short sitting ledge coupled to an arched or convex shaped back. The second of the two parts, the rocking portion, is a base capable of nesting inside the first part while not in use, and is further comprised of non-skid ribbing. This rocking portion may be turned over so as to be in a boat hull shaped position. In this position, the user may perform "rocking" movements and exercises. In the preferred embodiment, the main body and rocking portion are very strong and capable of being safely used by persons of various heights and different body weights. Therefore, in the preferred embodiment, the main body and rocking portion are constructed so as to provide significant wall strength that will withstand repeated use. Therefore, the present invention will accommodate different body sizes. Since this exercise equipment is expected to be used by adults of various weights and heights, adaptation through additional larger parts is unnecessary. It is believed that the equipment will be made available in only two sizes, so that the equipment may be manufactured as cost-efficiently as possible. Therefore, the shape and design of the equipment, provides stability, ease of use, and great sales potential.

SUMMARY OF THE INVENTION

It is an object of the present invention to provide exercise equipment that is stable, lightweight, easy to use and economical to manufacture. The Pilates Exercise Barrel of the present invention is easily moved and stored.

It is a further object of the present invention to provide a Pilates Exercise Barrel that may be used for a variety of special exercises.

In the preferred embodiment of the present invention, the Pilates Exercise Barrel is comprised of first and second parts. The first part, the main body, is comprised of an attachable body with a sitting ledge portion and an arched portion joined by sides to a common base. The underside of the main body is open and capable of receiving the second part, the rocking portion. The rocking portion may be used as a base for the main body for either stationary exercises (when in a stored position) or rocking exercises (when in a rocking position). The rocking portion provides stability to the main body, as it is further comprised of non-skid ribbing on its lower surface. When flipped over, the rocking portion may be used as a rocker and is of an inverted arch, or boat hull, shape. The rocking portion may be securely coupled to the main body.

BRIEF DESCRIPTION OF THE DRAWINGS

The above mentioned features and objects together with further features in accordance with the claims presented will become more apparent in the following description and accompanying drawings, wherein like reference numerals denote like elements in which:

DESCRIPTION OF THE PREFERRED EMBODIMENT

Figure 1:
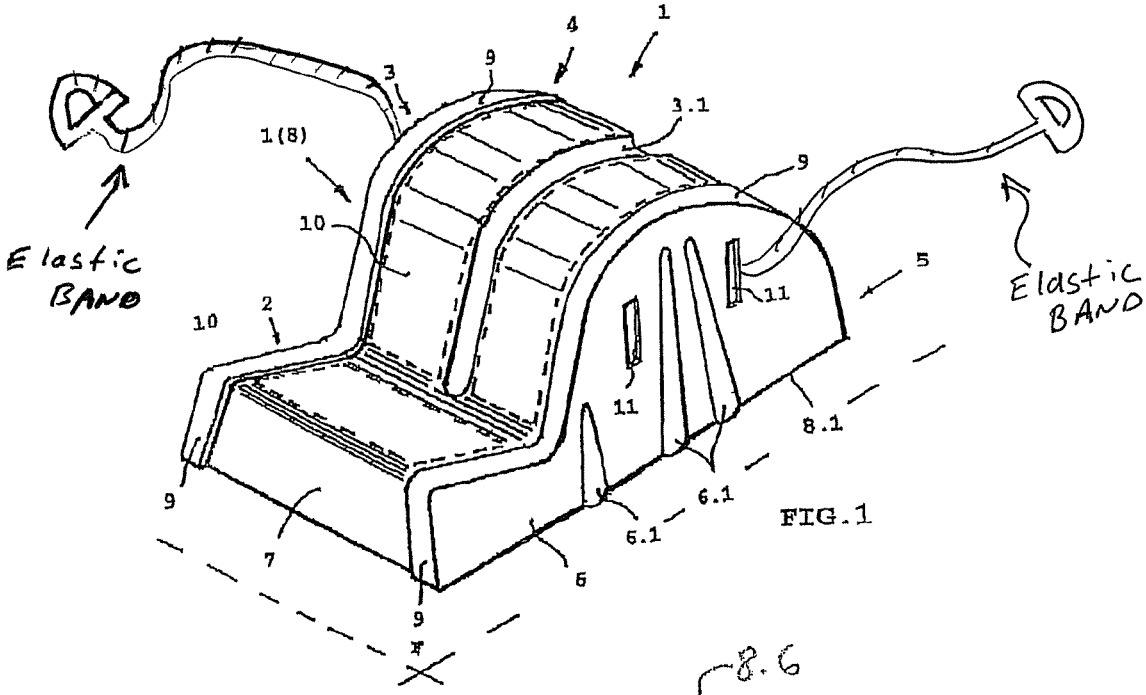
FIG. 1 is an isometric, left, front, and top view of the Pilates Exercise Barrel in user position, in accordance with a preferred embodiment.
Figure 2:
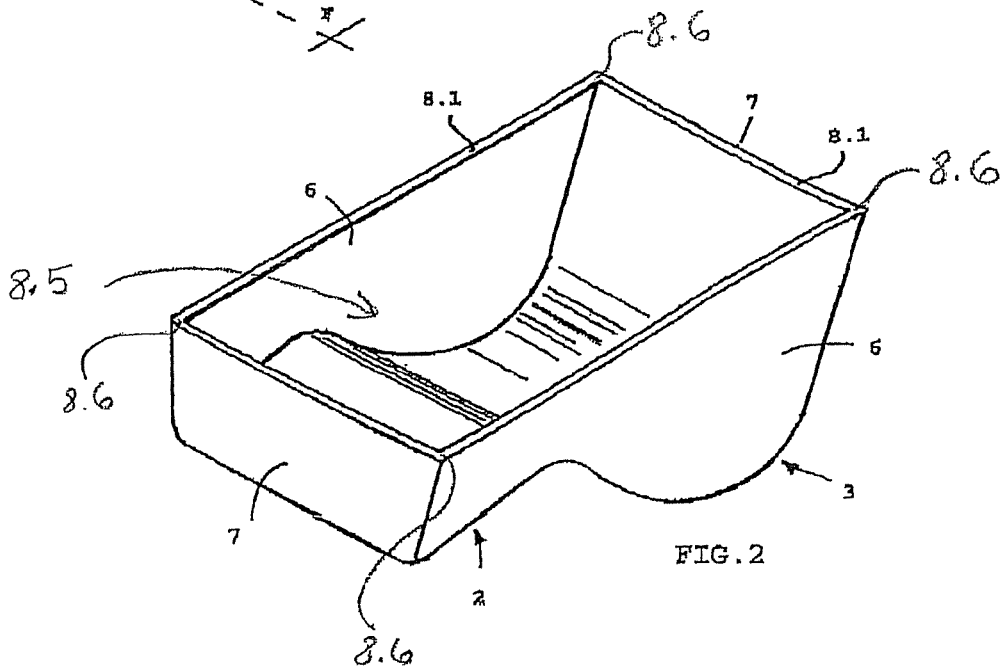
FIG. 2 is a simplified isometric, front, right and bottom view of the Pilates Exercise Barrel in accordance with a preferred embodiment.

Referring to FIGS. 1-5, the Pilates Exercise Barrel 8 is comprised of a main body 1 and a rocking portion 12 capable of resting on a surface F, with the main body comprised of a user area 4. This user area 4 is comprised of a sitting part 2 and an arched part 3. The sitting part 2 and arched part 3 are supported by side 6 and end walls 7, which walls 6, 7 form a common base 5. Referring to FIG. 2, the sidewalls 6 and end walls 7 form a rim 8.1. When viewed from the underside, the rim defines an opening 8.5. In FIG. 2 the underside of the main body 1 is shown in simpler form, omitting constructive details.

The barrel 8 may be formed from thin a sheet of metal. Although, the barrel 8 may be formed from thin sheet metal, in the preferred embodiment, the Pilates Exercise Barrel 8 is preferably formed from a liquid pour or plastic spray. Conventional manufacturing methods such as a two-part pour or spray form may be used. Because the side walls 6 and the front walls 7 are slanted, the barrel 8 may be easily extracted from the form. Furthermore, the opening 8.5 provides the advantage that in addition to nesting the rocking portion 12, several barrels 8 may be nested in one another. This nesting feature saves space for storage and shipping.

Figure 7:
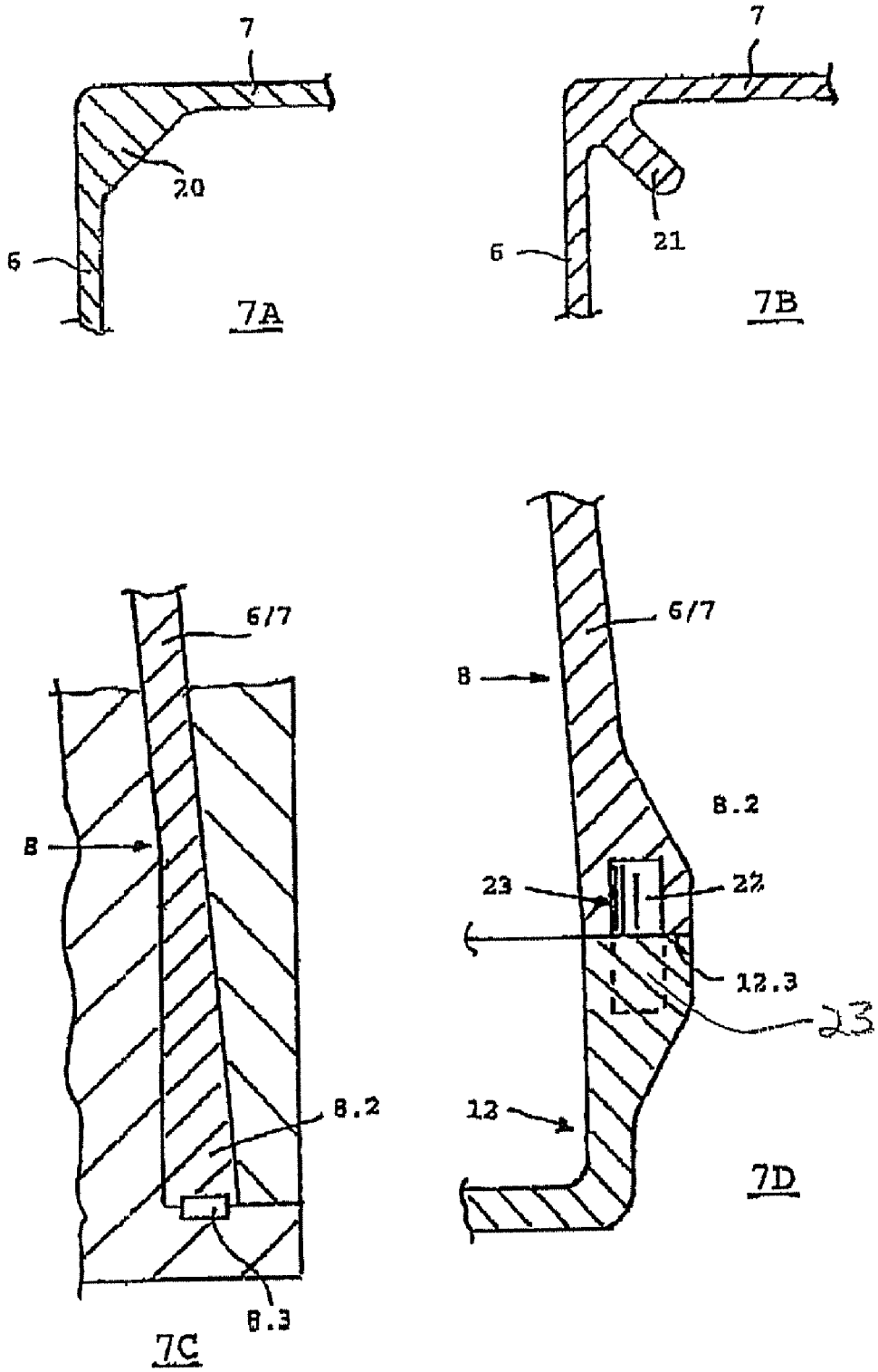
FIG. 7 shows two alternative embodiment sections 7A-7B and 7D of wall enforcement and 7C-7D of alternative embodiment of coupling mechanisms between the main body and rocking portion.

The sidewalls 6 provide stabilization and strength to the barrel 8. The sidewalls 6 are comprised of outward arching stabilization ribs 6.1, as shown in FIG. 1. As shown in FIGS. 7A & 7B, in addition to the strengthening ribs 6.1, the barrel 8 is further reinforced with corner wedge-directed ribs 21 and wall reinforcement ribs 20. Such corner 21 ribs and wall reinforcement ribs 20 may extend from the rim 8.1 to the top so as to make the barrel 8 stronger. Examples of such reinforcement made clear in FIG. 7 and will be explained further.

To provide the user of support, whether in a sitting or prone position, both sides 6 along the sitting part 2 and the arched or bending part 3 may be further comprised of rim protrusions 9 shown in FIG. 1. In the preferred embodiment, the material comprising these protrusions 9 is rounded off. The sitting part 2 and the bending part 3, for reasons of comfort, are preferably equipped with a one-piece or also several pieces of padding 10 or upholstery 10. Such padding 10 is shown in phantom in FIGS. 1 and 3. In the preferred embodiment 1, the padding 10 in the arched part 3 has an open end, or groove 3.1. This groove 3.1 provides a better back position for the users' spine and aligns with the protruding vertebrae of the user's spinal column when the user is bending over the bending portion 3. In the preferred embodiment, the groove 3.1 is an open space, the groove 3.1 may also be in the rubber matting 10.

Some users may find it desirable to perform resistance training exercises such as arm-spreading or also leg spreading under resistance. For these exercises, there are openings 11 located in the sidewalls 6 which are capable of receiving one end of an elastic band.

In the Pilates Exercise Barrel, the rim 8.1 of barrel 8 has a skid resistant layer 8.3 to counteract the skidding or movement of the barrel 8 on the surface area F.

Figure 3:
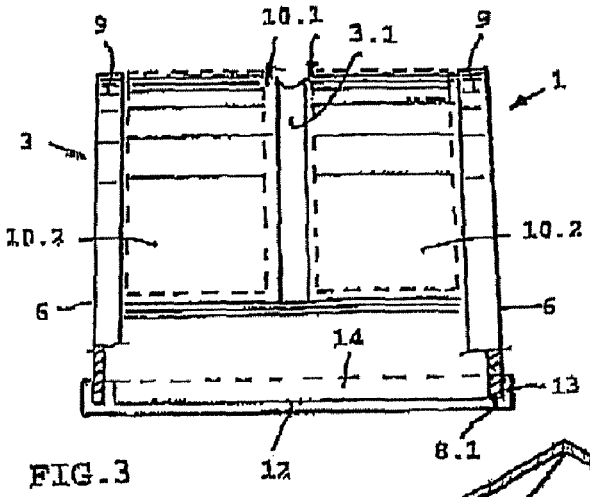
FIG. 3 is a front partial cutaway view of the Pilates Exercise Barrel in accordance with a preferred embodiment.
Figure 4:
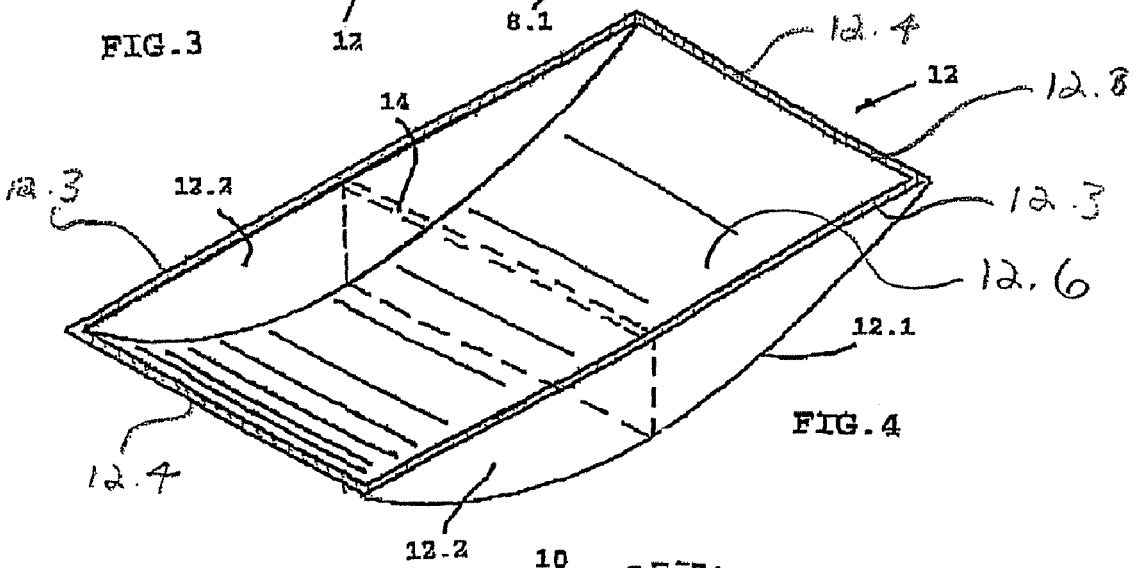
FIG. 4 is a bottom and side isometric view of the rocking portion of the Pilates Exercise Barrel in accordance with a preferred embodiment.
Figure 5:
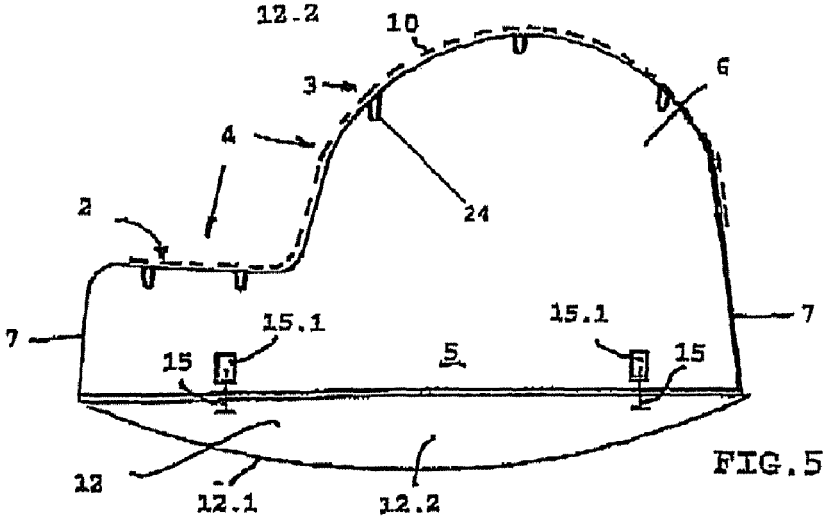
FIG. 5 is a left side elevation view of the Pilates Exercise Barrel with the rocking portion in the rocking position, in accordance with a preferred embodiment.

Referring to FIGS. 3, 4, and 5, the Pilates Exercise Barrel 8 is further comprised of a rocking portion 12. The rocking portion 12 of the Pilates Exercise Barrel 1 is removably coupled to the opening rim 8.1 of the barrel 8. The rocking portion 12, referring to FIGS. 4 and 5, is comprised of an open portion 12.6, an arch portion 12.1, and sidewalls 12.2. The free rims 12.3 of the side walls 12.2 and the rims 12.4 of the arch 12.1 are co-planar, which allow the rocking portion 12 to lie flat with the arched portion 12.1 extending upward, or, the rocking portion 12 may be placed in the rocking position shown best in FIGS. 4 and 5. In this position, the rocking portion 12 may be coupled to the rim 8.1 of barrel 8 as shown in FIG. 5. In this way the rim 8.1 of barrel 8 is encircled on all sides and cannot bend outward. In FIG. 3 there is shown a different embodiment. In this embodiment, the rim 12.3 of the rocking portion 12 is formed in the form of a nut 13 which is placed into the rim 8.1 of the barrel 8. That is to say the rim 8.1 of barrel 8 is secured against bowing toward the outside as well as inside. In FIG. 4, the rocking portion 12 is shown with a skid-proof overlay 12.8 or with skid-proof elements.

The rocking portion 12 according to the embodiments shown in FIGS. 4 and 5 serves, for instance, to give the user an ability to develop balance skills and, due to the rocking aspects of the invention, the ability to train and develop the neurological and muscular systems. If balance exercises are desired, the user takes the apparatus according to FIG. 1 by hand or leans it on its side and couples the rocking portion 12 to the rim 8.1 of the barrel 8. In alternative embodiments, the rim 8.1 of the barrel 8 may be fitted loose or fixed within the rim 13. In FIG. 3, the main body 8 is inserted between the rocking portion 12 sidewalls 12.2.

The rocking portion 12 may be coupled to the rim 8.1 in a number of ways. In the preferred embodiment shown in FIG. 5, the rocking portion 12 is coupled with the barrel 8 with quick release locks 15, which allow attachment to the base 5 of the barrel 8 through attachment openings 15.1.

Figure 6:
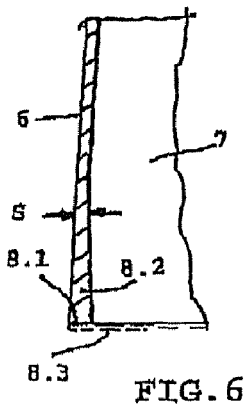
FIG. 6 shows a partial section of a side panel.

In FIGS. 7A to 7D, alternative embodiments of the previously mentioned wall and rim strengthening are shown which help stabilize the barrel 8. Referring to FIGS. 7A and 7B, the bracing for a corner 8.6 is shown for all four corners of the main body 1 or the rocking portion 12. In the Pilates Exercise Barrel, the barrel 8 (FIG. 7A) has a thicker material 20 at the corner. In the embodiment shown in FIG. 7B, a rib 21 oriented 45, degrees to the neighboring walls 6 and 7, helps reinforce the corner. FIG. 7C basically corresponds to FIG. 6 somewhat enlarged. The two body-drawn parts of a pouring form or a spray pour form have been included for clarity. FIG. 7D shows a different manner of coupling the main body 8 to the rocking portion 12 wherein the rocking portion 12, whose strengthened rim 12.3 is comprised of attachment pins 22, which are installable in corresponding holes 23 in the rim strengthening 8.2 of the barrel 8.

In another embodiment, speed-tension locks 15, as shown in FIG. 5 may be added to provide additional stability and safety. On the non-weight bearing portions of the barrel 8, the wall thickness is as thin as possible. On the weight bearing portions, additional diagonal ribs 24 are included, as depicted in FIG. 5.

Figure 8:
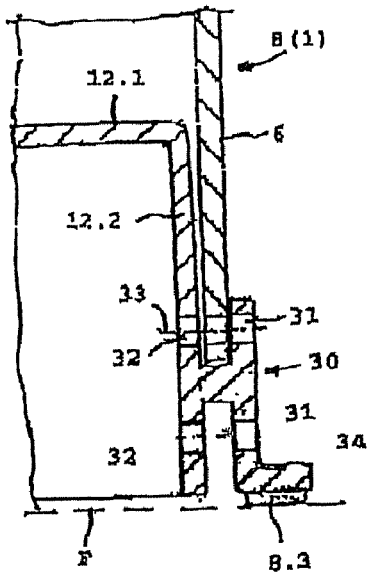
FIG. 8 shows in partial section the coupling of the main portion and rocking portion as it appears in the stowed position, in a preferred embodiment.
Figure 9:
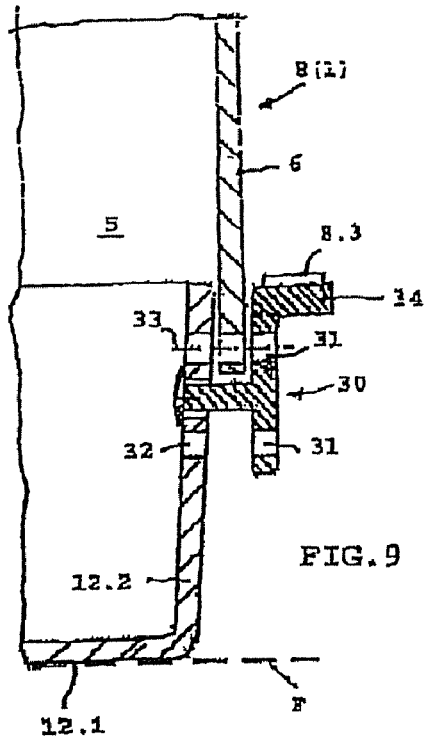
FIG. 9 shows the Pilates Exercise Barrel of FIG. 8 with the rocking portion of the Pilates Barrel in the rocking position.
Figure 10:
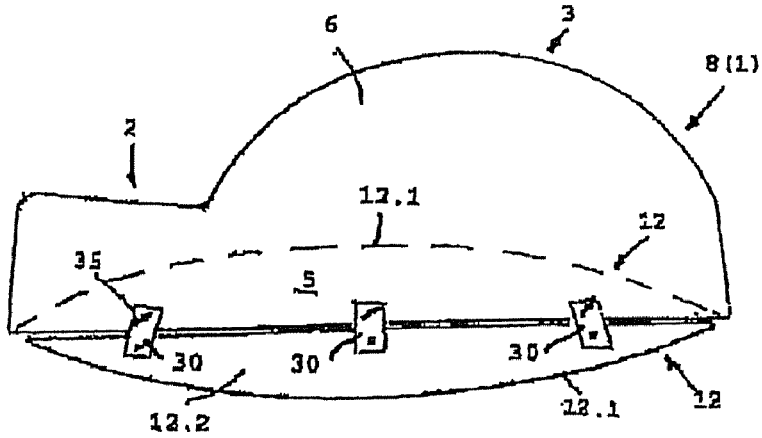
FIG. 10 is a side plan view of the Pilates Exercise Barrel with the rocking portion attached to the main body.

In the FIGS. 8-10, additional coupling embodiments are shown. The arched rocking base 12 may be nested within the main body 1 to form one unit. In FIGS. 8 and 9, the sidewall part 6 is shown nested with the shell 12. As shown, the rocking base 12 may be inserted such that the rocking portion 12 is in the rocking position as shown in FIG. 9, or in the stored position, as shown in FIG. 8.

Since many modifications, variations and changes in detail can be made to the described preferred embodiments of the invention, it is intended that all matters in the foregoing description and shown in the accompanying drawings be interpreted as illustrative and within the scope and spirit of this invention and not in a limiting sense. Thus, the scope of the invention should be determined by the appended claims and their legal equivalents.

I claim:

1. An exercise apparatus comprising a main body and a rocking portion, said main body being comprised of a first base, a plurality of walls, and a user area, said user area being comprised of a sitting portion and a bending portion, wherein said bending portion is above the sitting portion when a user is seated on said sitting portion, wherein said base is formed by said walls, wherein said walls, sitting portion, and bending portion form an opening; and wherein said rocking portion is comprised of a second base, a plurality of rocking portion walls, and an arched surface.

2. The exercise apparatus of claim 1, wherein the first base is comprised of attachment pins and wherein said second base is comprised of openings capable of receiving said attachment pins.

3. The exercise apparatus of claim 1, wherein the second base is comprised of attachment pins and wherein said first base is comprised of openings capable of receiving said attachment pins.

4. The exercise apparatus of claim 1, wherein the rocking portion is coupled to the main body by speed tension locks.

5. The exercise apparatus of claim 1, wherein said main body is further comprised of corner wedges.

6. The exercise apparatus of claim 1, wherein said rocking portion is further comprised of corner wedges.

7. The exercise apparatus of claim 5, wherein said corner wedges are positioned at 45° angles to a side and a front wall.

8. The exercise apparatus of claim 6, wherein said corner wedges are positioned at 45° angles to a side and a front wall.

9. The exercise apparatus of claim 1, wherein the user area is comprised of stabilizing ribs.

10. The apparatus of claim 1, further comprising a plurality of fasteners fashioned in the form of T-parts and wherein said walls have holes for attachment of a holding pin.

11. The apparatus of claim 10, where the fasteners are integrated within the walls of the rocking portion.

12. The apparatus of claim 10 wherein the fasteners are integrated within the rocking portion.

13. The apparatus of claim 10, wherein the holding pins are fitted with wing nuts.

* * * * *